US008664506B2

(12) United States Patent
Yamanouchi

(10) Patent No.: US 8,664,506 B2
(45) Date of Patent: Mar. 4, 2014

(54) ELECTRONIC PERCUSSION INSTRUMENT AND RECORDING MEDIUM WITH PROGRAM RECORDED THEREIN

(75) Inventor: Morio Yamanouchi, Fussa (JP)

(73) Assignee: Casio Computer Co., Ltd., Tokyo (JP)

( * ) Notice: Subject to any disclaimer, the term of this patent is extended or adjusted under 35 U.S.C. 154(b) by 56 days.

(21) Appl. No.: 13/287,232

(22) Filed: Nov. 2, 2011

(65) Prior Publication Data

US 2012/0111179 A1 May 10, 2012

(30) Foreign Application Priority Data

Nov. 5, 2010 (JP) ..... 2010-248064

(51) Int. Cl.
*G10H 3/00* (2006.01)

(52) U.S. Cl.
USPC ..... 84/723; 84/422.4; 84/658; 84/735

(58) Field of Classification Search
None
See application file for complete search history.

(56) References Cited

U.S. PATENT DOCUMENTS

| | | | | |
|---|---|---|---|---|
| 5,290,964 | A * | 3/1994 | Hiyoshi et al. | 84/600 |
| 5,585,584 | A * | 12/1996 | Usa | 84/600 |
| 5,648,627 | A * | 7/1997 | Usa | 84/600 |
| 6,759,583 | B2 * | 7/2004 | Mizuno et al. | 84/422.4 |
| 7,135,637 | B2 * | 11/2006 | Nishitani et al. | 84/723 |
| 7,179,984 | B2 * | 2/2007 | Nishitani et al. | 84/723 |
| 7,183,480 | B2 * | 2/2007 | Nishitani et al. | 84/615 |
| 7,781,666 | B2 * | 8/2010 | Nishitani et al. | 84/723 |
| 7,896,742 | B2 * | 3/2011 | Weston et al. | 463/37 |
| 2001/0015123 | A1 * | 8/2001 | Nishitani et al. | 84/615 |
| 2003/0066413 | A1 * | 4/2003 | Nishitani et al. | 84/615 |
| 2003/0167908 | A1 * | 9/2003 | Nishitani et al. | 84/723 |
| 2004/0025666 | A1 * | 2/2004 | Mizuno et al. | 84/422.4 |
| 2006/0185502 | A1 * | 8/2006 | Nishitani et al. | 84/615 |
| 2012/0006181 | A1 * | 1/2012 | Harada et al. | 84/600 |
| 2012/0024128 | A1 * | 2/2012 | Takahashi | 84/600 |
| 2012/0090448 | A1 * | 4/2012 | Yamanouchi | 84/723 |
| 2012/0103168 | A1 * | 5/2012 | Yamanouchi | 84/723 |
| 2012/0111179 | A1 * | 5/2012 | Yamanouchi | 84/723 |
| 2012/0152087 | A1 * | 6/2012 | Sakazaki | 84/600 |
| 2012/0216667 | A1 * | 8/2012 | Sakazaki | 84/725 |

FOREIGN PATENT DOCUMENTS

| | | | |
|---|---|---|---|
| JP | 06-075571 | A | 3/1994 |
| JP | 09-127937 | A | 5/1997 |
| JP | 2000-172258 | A | 6/2000 |
| JP | 2004-302011 | A | 10/2004 |

OTHER PUBLICATIONS

Japanese Office Action dated Sep. 26, 2012 (and English translation thereof), issued in counterpart Japanese Application No. 2010-248064.

* cited by examiner

*Primary Examiner* — Marlon Fletcher
(74) *Attorney, Agent, or Firm* — Holtz, Holtz, Goodman & Chick, PC

(57) ABSTRACT

An electronic percussion instrument including: a detecting section which is provided in a stick and detects acceleration and angular speed based on movement of the stick; a first timing generating section which generates beat timing based on a predetermined tempo and beat width; a first pre-sound-production movement detecting section which detects a pre-sound-production movement that is performed prior to sound production, based on the acceleration and the angular speed detected by the detecting section; and a sound production instructing section which instructs to produce a sound at the beat timing generated by the first timing generating section, when the first pre-sound-production movement detecting section detects the pre-sound-production movement.

3 Claims, 11 Drawing Sheets

ELECTRONIC PERCUSSION INSTRUMENT AND RECORDING MEDIUM WITH PROGRAM RECORDED THEREIN

CROSS-REFERENCE TO RELATED APPLICATION

This application is based upon and claims the benefit of priority from the prior Japanese Patent Application No. 2010-248064, filed Nov. 5, 2010, the entire contents of which is incorporated herein by reference.

BACKGROUND OF THE INVENTION

1. Field of the Invention

The present invention relates to an electronic percussion instrument capable of beating out an accurate rhythm and a recording medium with a program recorded therein.

2. Description of the Related Art

An electronic percussion instrument is known that detects the movement of a stick (drumstick) held by a user and generates a percussion instrument sound. For example, Japanese Patent Application Laid-Open (Kokai) Publication No. 06-075571 discloses a stick (drumstick) provided with a piezoelectric gyro sensor that detects angular speed. In a percussion instrument disclosed therein, when a user grips the stick and swings it downward or to the right, a snare drum sound or a cymbal sound is designated based on the downward component or the rightward component of sensor output (angular speed) from a sensor that has detected the movement, and the designated snare drum sound or cymbal sound is produced at a volume based on the sensor output level.

However, all that is achieved in the electronic percussion instrument disclosed in Japanese Patent Application Laid-Open (Kokai) Publication No. 06-075571 is that a musical sound intended to be produced and the volume of the sound are designated based on sensor output from the sensor that has detected the movement of the stick. Therefore, when movements similar to those of an actual drum performance, in which the stick is swung upward and downward, are performed in the air, the stick swung downwards strikes nothing, and so the physical bounce of the stick (impact feeling) does not occur, which makes a musical performance difficult. Accordingly, beating out an accurate rhythm is difficult in this electronic percussion instrument.

An object of the present invention is to provide an electronic percussion instrument capable of beating out an accurate rhythm and a recording medium with a program recorded therein.

SUMMARY OF THE INVENTION

In accordance with one aspect of the present invention, there is provided an electronic percussion instrument comprising: a detecting section which is provided in a stick and detects acceleration and angular speed based on movement of the stick; a first timing generating section which generates beat timing based on a predetermined tempo and beat width; a first pre-sound-production movement detecting section which detects a pre-sound-production movement that is performed prior to sound production, based on the acceleration and the angular speed detected by the detecting section; and a sound production instructing section which instructs to produce a sound at the beat timing generated by the first timing generating section, when the first pre-sound-production movement detecting section detects the pre-sound-production movement.

In accordance with another aspect of the present invention, there is provided an electronic percussion instrument comprising: a stick and a main body section; wherein the stick includes: a detecting section which detects acceleration and angular speed based on movement of the stick; a second timing generating section which generates beat timing based on a predetermined tempo and beat width; a second pre-sound-production movement detecting section which detects a pre-sound-production movement that is performed prior to sound production, based on the acceleration and the angular speed detected by the detecting section; a second judging section which judges whether or not the second pre-sound-production movement detecting section has detected the pre-sound-production movement between a predetermined amount of time before a preceding beat timing and a predetermined amount of time before a current beat timing; and a transmitting section which transmits a pre-sound-production movement detection signal, when the second judging section judges that the pre-sound-production movement has been detected; and the main body section includes: a receiving section which receives the pre-sound-production movement detection signal transmitted from the stick; a third timing generating section which generates beat timing based on a predetermined tempo and beat width; and a sound production instructing section which instructs to produce a sound at the beat timing generated by the third timing generating section, when the receiving section receives the pre-sound-production movement detection signal.

The above and further objects and novel features of the present invention will more fully appear from the following detailed description when the same is read in conjunction with the accompanying drawings. It is to be expressly understood, however, that the drawings are for the purpose of illustration only and are not intended as a definition of the limits of the invention.

DETAILED DESCRIPTION OF THE PREFERRED EMBODIMENTS

The preferred embodiments of the present invention will hereinafter be described with reference to the drawings.

[First Embodiment]

A. Structure

Figure 1:
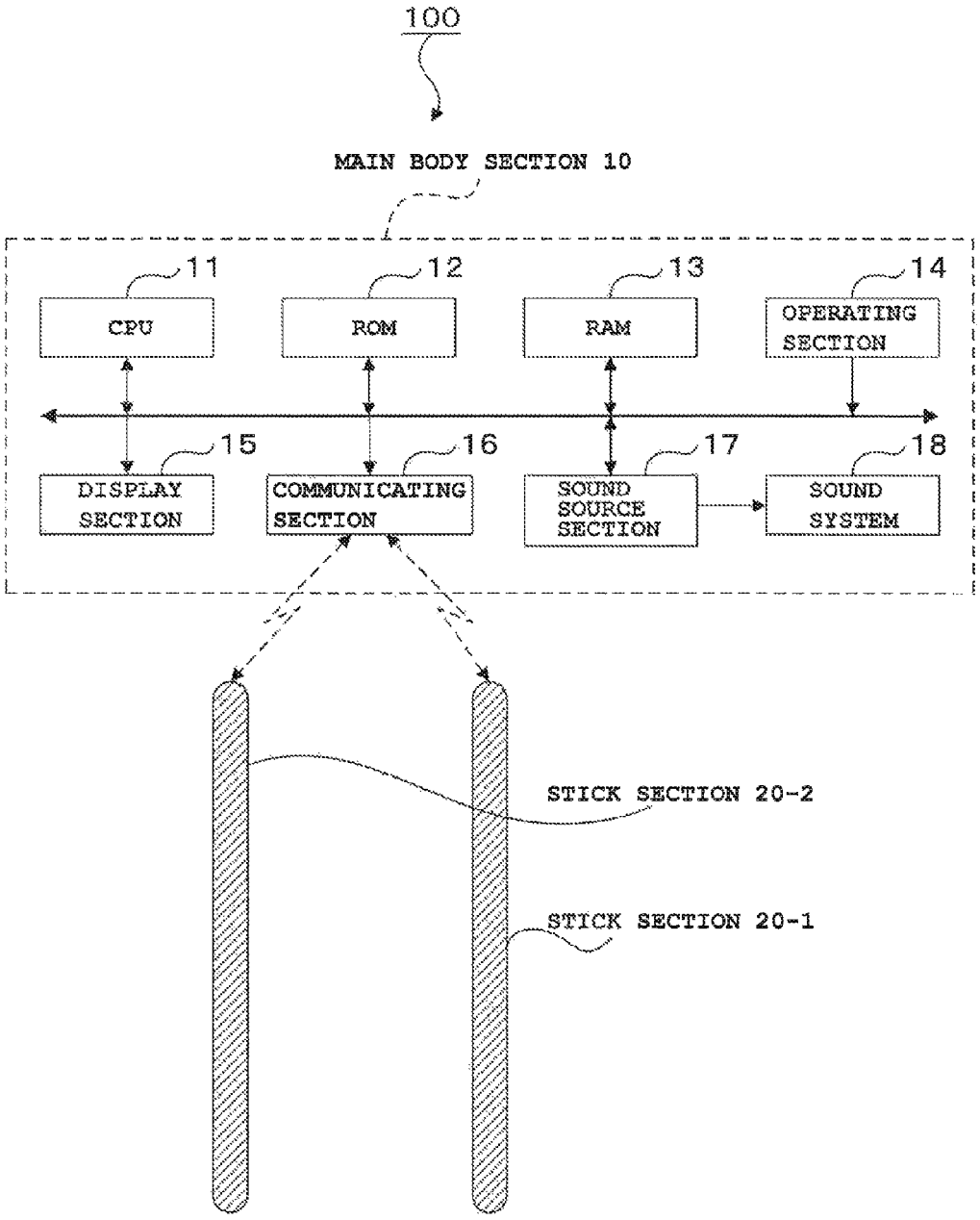
FIG. 1 is a block diagram showing the overall structure of an electronic percussion instrument 100 according to a first embodiment.

FIG. 1 is a block diagram showing the overall structure of an electronic percussion instrument 100 according to a first embodiment. The electronic percussion instrument 100 shown in FIG. 1 is broadly divided into a main body section 10, and stick sections 20-1 and 20-2 (stick) that are respectively gripped in the left and right hands of a user. The structure of the main body section 10 and the structure of the stick section 20 will hereinafter be described separately.

(1) Structure of Main Body Section 10

The main body section 10 includes a central processing unit (CPU) 11 (first timing generating section, first pre-sound-production movement detecting section, sound production instructing section and first judging section), a read-only memory (ROM) 12, a random access memory (RAM) 13, an operating section 14, a display section 15, a communicating section 16, a sound source section 17 and a sound system 18. The CPU 11 generates beat timing (quantized beat timing) based on, for example, the tempo of a song intended to be played and its beat width (quantized beat width) by performing main body processing (see FIG. 6) described hereafter. Then, when a pre-sound-production movement (a movement indicating the intention of producing a sound) that is performed prior to sound production is detected based on acceleration data and angular speed data generated by the stick section 20, the CPU 11 instructs to produce a percussion instrument sound at the beat timing that comes immediately after the detection of the pre-sound-production movement (pre-sound-production stage movement).

The ROM 12 stores various program data, control data, and the like loaded by the CPU 11. The various programs here include the main body processing (see FIG. 6) described hereafter. The RAM 13 includes a work area and a data area. The work area of the RAM 13 temporarily stores various register and flag data used for processing by the CPU 11, in which a counter register that generates beat timing based on a tempo and a beat width set by a user operation is provided. The data area of the RAM 13 stores acceleration data and angular speed data of the stick sections 20-1 and 20-2 received and demodulated via the communicating section 16 described hereafter. Note that identification data, which identifies by which of the stick section 20-1 or the stick section 20-2 acceleration data or angular speed data has been generated, is added to acceleration data and angular speed data stored in the data area of the RAM 13.

The operating section 14 includes a power switch for turning ON and OFF the power of the main body section 10, a play switch for giving an instruction to start or end a musical performance, a switch for setting a tempo and a beat width, and the like, and generates an event based on a switch operation. Events generated by the operating section 14 are received by the CPU 11. The display section 15 displays the operation status or the setting status of the main body section 10 based on display control signals supplied by the CPU 11.

The communicating section 16 receives and demodulates acceleration data and angular speed data (including identification data) wirelessly transmitted from the operating sections 20-1 and 20-2 under the control of the CPU 11, and stores the received acceleration data in the data area of the RAM 13. The sound source section 17 is configured by the known waveform memory read-out method and replays waveform data of a musical sound (a percussion instrument sound) whose tone has been designated by the user, in accordance with a note-ON event supplied by the CPU 11. The sound system 18 converts the waveform data of a percussion instrument sound outputted from the sound source section 17 to an analog signal format, and produces the sound from a speaker after removing unnecessary noise and amplifying the level.

(2) Configuration of Stick Section 20

Figure 2:
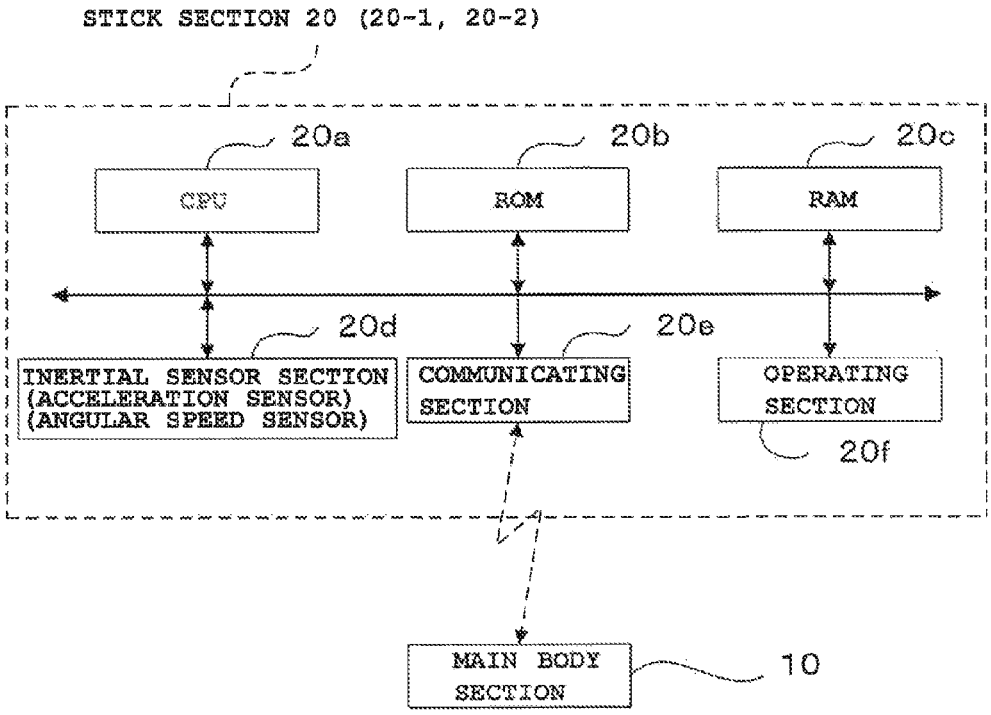
FIG. 2 is a block diagram showing the structure of a stick section 20 according to the first embodiment.

Next, the structures of the stick sections 20-1 and 20-2 will be described with reference to FIG. 2. As shown in FIG. 2, the stick sections 20-1 and 20-2 each includes components 20*a* to 20*f* inside a stick that serves as its housing. A CPU 20*a* performs stick processing (see FIG. 5) described hereafter. In the stick processing, when the play switch is turned ON, the CPU 20*a* stores in a RAM 20*c* acceleration data and angular speed data generated by sampling output from an inertial sensor section 20*d* (detecting section), and after reading out the acceleration data and angular speed data stored in the RAM 20*c*, wirelessly transmits them from a communicating section 20*e* to the main body section 10 side.

A ROM 20*b* stores various program data, control data, and the like which are loaded by the CPU 20*a*. The various programs here include the stick section processing (see FIG. 5) described hereafter. The RAM 20*c* includes a work area and a data area. The work area of the RAM 20*c* temporarily stores various register and flag data used for processing by the CPU 20*a*, and the data area of the RAM 20*c* temporarily stores acceleration data and angular speed data outputted from the inertial sensor section 20*d*.

The inertial sensor section 20*d* is constituted by, for example, a capacitive-type acceleration sensor that detects acceleration of three orthogonal axis components, a piezoelectric gyro-type angular speed sensor that detects angular speed of three orthogonal axis components and an analog-to-digital (A/D) converting section that performs A/D conversion on each output from the acceleration sensor and the angular speed sensor, and generates acceleration data and angular speed data.

Figure 3A:
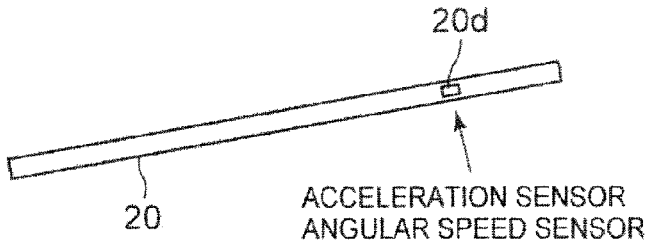
FIG. 3A and FIG. 3B are diagrams for explaining polarities of acceleration sensor output and angular speed sensor output that change depending on the movements of the stick section 20 being swung upwards and downwards.
Figure 4:
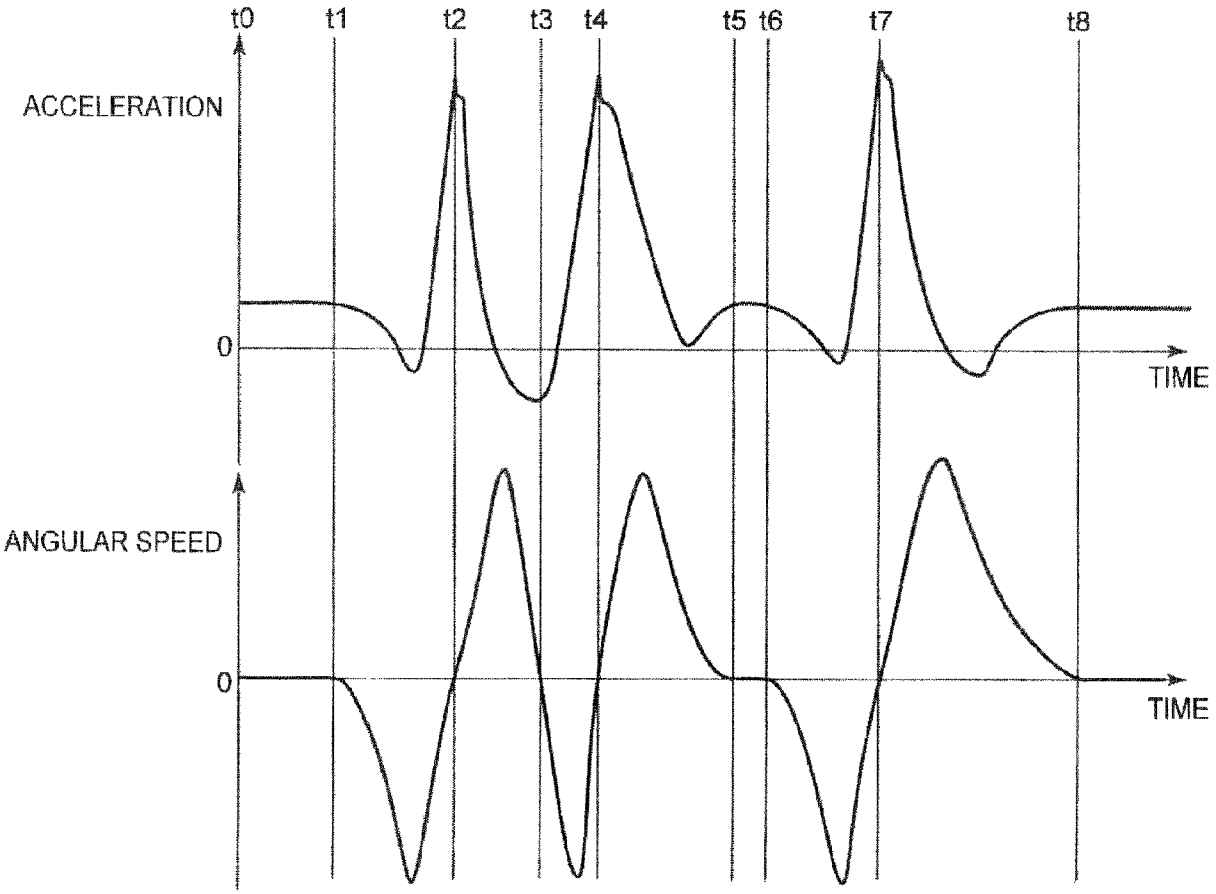
FIG. 4 is a diagram showing an example of output characteristics of an acceleration sensor and an angular speed sensor which change depending on the movements of the stick section 20 being swung upwards and downwards.

In a stationary state shown in FIG. 3A, the inertial sensor section 20*d* included in the stick section 20 indicates an output change from time t=0 to time t1 shown in FIG. 4. That is, the acceleration sensor detects an offset value corresponding to gravitational acceleration, and the angular speed sensor maintains zero output. Note that the acceleration in the example of output characteristics shown in FIG. 4 is the combined acceleration of a biaxial component of the stick other than in the longitudinal direction, and the direction in which an offset corresponding to gravitational acceleration is generated is defined as "+". In addition, the angular speed therein is a combined angular speed generated by the rotation of a biaxial component of the stick other than in the longitudinal direction.

Figure 3B:
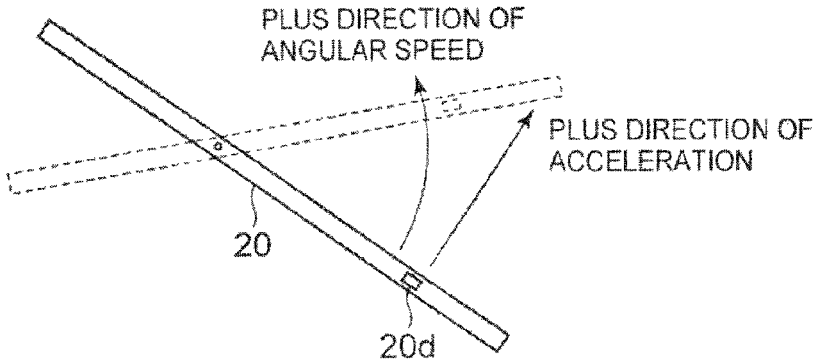

When the stick section 20 is swung downwards from the state in FIG. 3A to the state shown in FIG. 3B, the acceleration decreases in the minus direction and then rapidly increases in the plus direction, as is clear from the output change occurring from time t1 to time t2 in FIG. 4. On the other hand, the angular speed decreases in the minus direction to a predetermined level, and then increases to zero level. This movement made from time t1 to time t2, which is the movement of the stick section 20 being swung downward, is referred to as "pre-sound-production movement" indicating a movement performed prior to sound production (a movement indicating the intention of producing a sound) Similarly, the movement made from time t3 to time t4 and the movement made from time t5 to time t7 are also "pre-sound-production movements". In the main body section 10, this "pre-sound-production movement" is detected, as described hereinafter.

The communicating section 20*e* modulates acceleration data and angular speed data stored in the data area of the RAM 20*c* to data of a predetermined format, and wirelessly transmits them to the main body section 10 side. Note that identification data, which identifies by which of the stick sections 20-1 and 20-2 acceleration data or angular speed data has been generated, is added to acceleration data and angular speed data to be wirelessly transmitted. The operating section 20*f* includes a power switch for turning ON and OFF the power, a play switch for giving an instruction to start or end a musical performance, and the like, and generates an event based on a switch operation. Events generated by the operating section 20*f* are received by the CPU 20*a*.

B. Operations

Next, operations of the electronic percussion instrument 100 structured as above will be described with reference to FIG. 5 to FIG. 7. In the descriptions below, the operation of the stick processing performed by the CPU 20*a* on the stick 20 side and the operation of the main body processing performed by the CPU 11 on the main body section 10 side will be described as the operations of the electronic percussion instrument 100.

(1) Operation of Stick Processing

Figure 5:
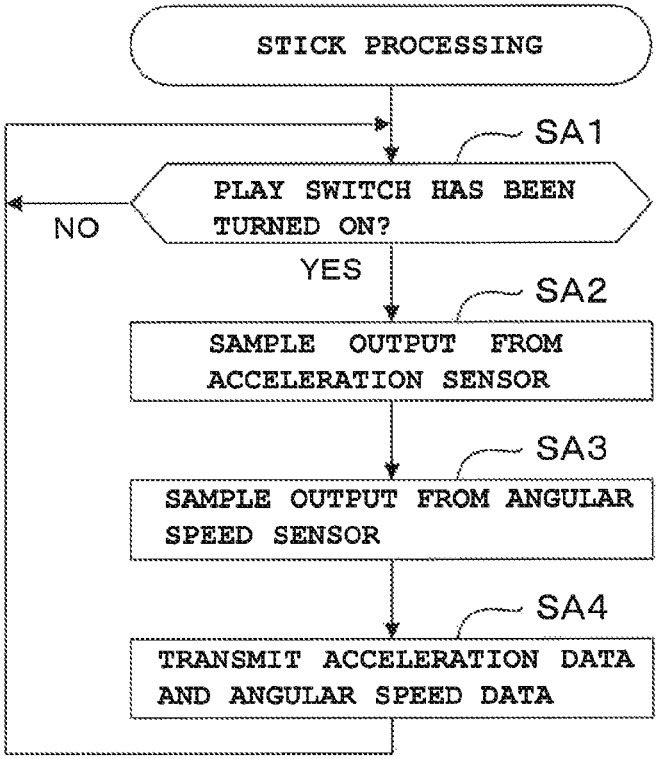
FIG. 5 is a flowchart of the operation of stick processing according to the first embodiment.
Figure 6:
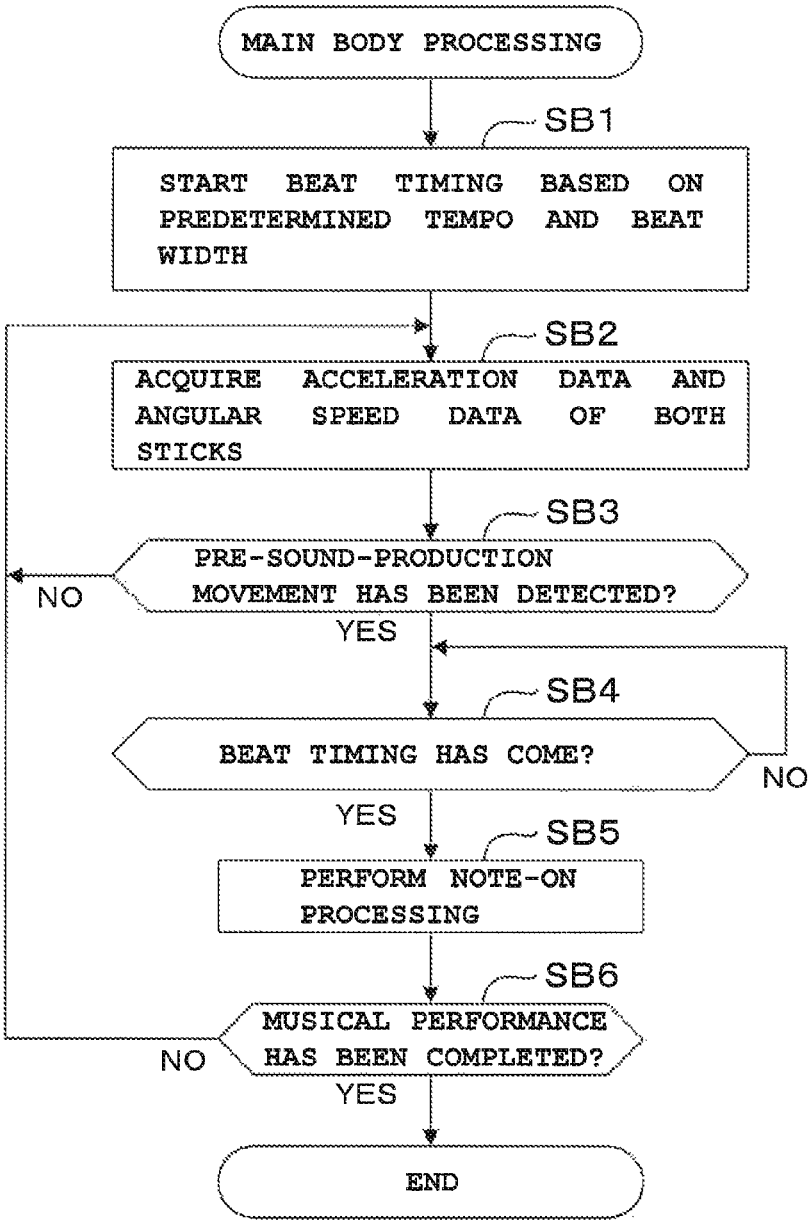
FIG. 6 is a flowchart of the operation of main body processing according to the first embodiment.

When the stick section 20 is turned ON by the operation of the power switch, the CPU 20*a* performs the stick processing shown in FIG. 5 and proceeds to Step SA1. At Step SA1, the CPU 20*a* judges whether or not the play switch has been set in an ON state that indicates the start of a musical performance. When judged that the play switch has not been set in the ON state, the CPU 20*a* waits until the play switch is set in the ON state. When the user sets the play switch in the ON state, a judgment result at Step SA1 is "YES" and the CPU 20*a* proceeds to Step SA2. At Step SA2, the CPU 20*a* stores acceleration data acquired by performing A/D conversion on acceleration sensor output from the inertial sensor section 20*d* in the RAM 20*c*.

Next, at Step SA3, the CPU 20*a* stores angular speed data acquired by performing A/D conversion on angular speed sensor output from the inertial sensor section 20*d* in the RAM 20*c*. Next, at Step SA4, the CPU 20*a* adds identification data, which identifies by which of the stick section 20-1 or the stick section 20-2 the acceleration data or the angular speed data has been generated, to the acceleration data and the angular speed data read out from the RAM 20*c*, and wirelessly transmits the acceleration data and angular speed data to the main body section 10 side from the communicating section 20*e*. Hereafter, until the play switch is set in an OFF state that indicates the end of a musical performance, the CPU 20*a* repeats Step SA1 to Step SA4 described above, and generates and wirelessly transmits acceleration data that changes depending on the stick operation performed by the user.

(2) Operation of Main Body Processing

Next, the main body processing performed by the CPU 11 on the main body section 10 side will be described with reference to FIG. 6. When the main body section 10 is turned ON by the operation of the power switch, the CPU 11 performs the main body processing shown in FIG. 6 and proceeds to Step SB1. At Step SB1, the CPU 11 starts beat timing based on a predetermined tempo and beat width. Then, at Step SB2, the CPU 11 receives and demodulates acceleration data and angular speed data (including identification data) wirelessly transmitted from the stick section 20-1 and the stick section 20-2, and stores them in a predetermined area of the RAM 13.

Next, at Step SB3, the CPU 11 judges whether or not a pre-sound-production movement has been detected based on the acquired acceleration data and angular speed data. This detection of a pre-sound-production movement may be performed by detecting, for example, whether or not the angular speed data has reached a predetermined threshold value or less, whether or not the angular speed data has reached a minimum that is less than a predetermined threshold value, or whether or not the acceleration data has reached a certain threshold value or more after reaching a minimum that is equal to or less than a predetermined threshold value. That is, the detection method may be any method that allows the movement of the stick being swung downward to be recognized as a movement performed prior to sound production.

When judged that a pre-sound-production movement which is performed prior to sound production has not been detected, the judgment result at Step SB3 is "NO" and the CPU 11 returns to Step SB2. When judged that a pre-sound-production movement has been detected, the judgment result at Step SB3 is "YES" and the CPU 11 proceeds to Step SB4. At Step SB4, the CPU 11 judges whether or not the beat timing has come. When judged that the beat timing has not come, the CPU 11 waits until the beat timing comes. When judged that the beat timing has come, the judgment result is "YES" and the CPU 11 proceeds to Step SB5. At Step SB5, the CPU 11 performs note-ON processing for generating a note-ON event and supplying the note-ON event to the sound source section 17.

Figure 7:
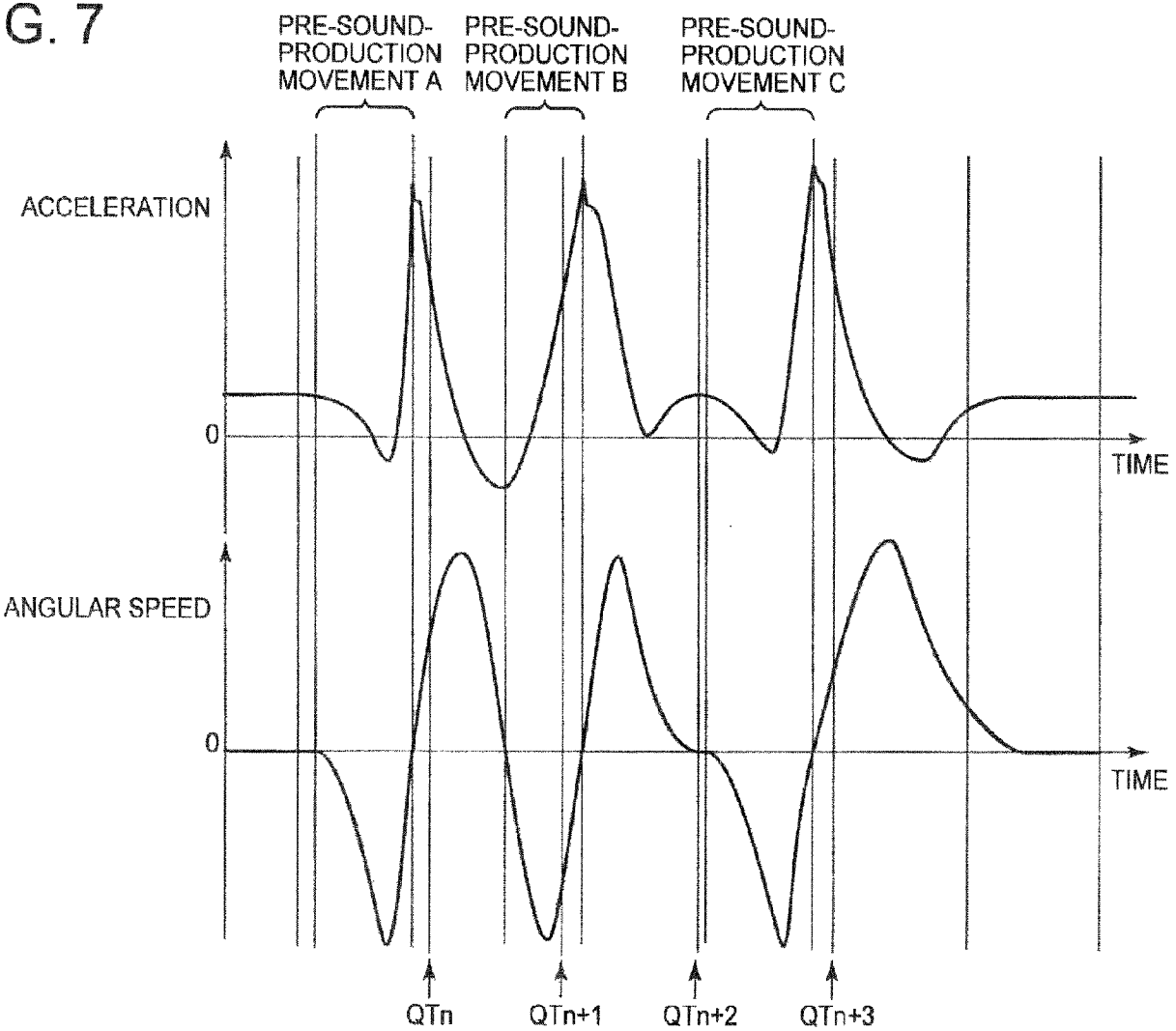
FIG. 7 is a diagram for explaining the movements of the first embodiment.

Accordingly, in a case where the stick section 20 is being moved to be swung upward and downward as shown in the example of output characteristics in FIG. 7, first, a note-ON event is generated at beat timing QTn that comes immediately after the detection of a pre-sound-production movement A. Next, another note-ON event is generated at beat timing QTn+2 that comes immediately after the detection of a pre-sound-production movement B. Next, yet another note-ON event is generated at beat timing QTn+3 that comes immediately after the detection of a pre-sound-production movement C. Therefore, when a suitable beat width is set in advance considering the tempo of a song to be played on the drums, even a novice user who is unfamiliar with stick operation can give an instruction to produce a sound at beat timing that comes immediately after the detection of a pre-sound-production movement (the movement of the stick being downward which is performed prior to sound production). Thus, an accurate rhythm can be beaten out.

Next, the CPU 11 proceeds to Step SB6 and judges whether or not an instruction to end the musical performance has been given by the operation of the play switch. When judged that an instruction to end the musical performance has not been given, the judgment result is "NO" and the CPU 11 returns to the processing at Step SB2. Conversely, when judged that an instruction to end the musical performance has been given, the judgment result at Step SB6 is "YES" and the CPU 11 completes the main body processing.

As described above, in the first embodiment, each stick section 20-1 and 20-2 individually generates and wirelessly transmits acceleration data and angular speed data that change depending on the stick operation by the user, and the main body section 10 side receives them. In the main body section 10, beat timing is generated based on, for example, the tempo of a song to be played and its beat width. Then, when a pre-sound-production movement that is performed prior to sound production is detected based on the acceleration data and the angular speed data generated by the stick section 20, an instruction to produce a sound is given at the beat timing that comes immediately after the detection. As a result, an accurate rhythm can be beaten out.

[Variation Example of the First Embodiment]

Figure 8:
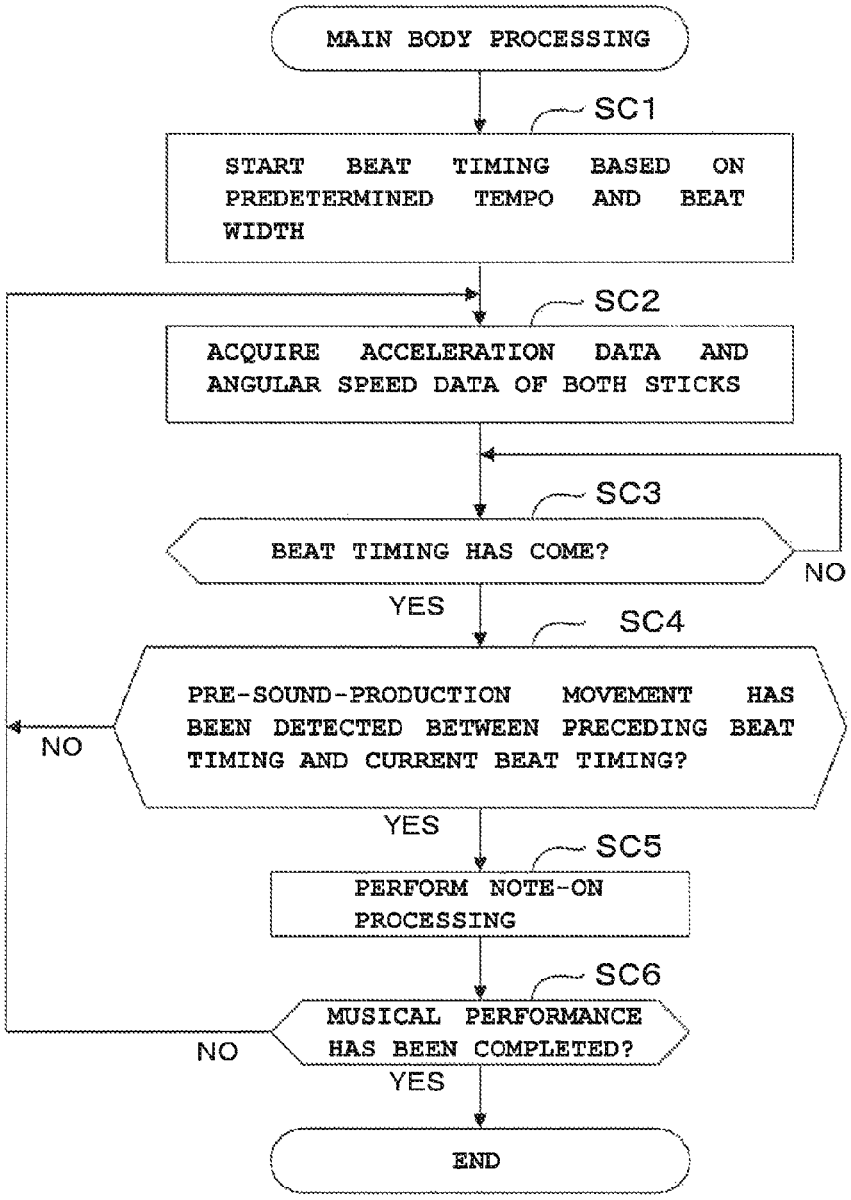
FIG. 8 is a flowchart showing a variation example of the operation of the main body processing according to the first embodiment.

Next, the operation of main body processing in a variation example of the above-described first embodiment will be described with reference to FIG. 8. As in the case of the first embodiment, when the main body section 10 is turned ON by the operation of the power switch, the CPU 11 performs the main body processing shown in FIG. 8 and proceeds to Step SC1. At Step SC1, the CPU 11 starts beat timing based on a predetermined tempo and beat width. Then, at Step SC2, the CPU 11 receives and demodulates acceleration data and angular speed data (including identification data) wirelessly transmitted from the stick section 20-1 and the stick section 20-2, and stores them in a predetermined area of the RAM 13.

Next, at Step SC3, the CPU 11 judges whether or not the beat timing has come. When judged that the beat timing has not come, the CPU 11 waits until the beat timing comes. When judged that the beat timing has come, the judgment result is "YES" and the CPU 11 proceeds to Step SC4, At Step SC4, the CPU 11 judges whether or not a pre-sound-production movement has been detected between the preceding beat timing and the current beat timing. When judged that a pre-sound-production movement has not been detected, the judgment result is "NO" and the CPU 11 returns to the processing at Step SC2. When judged that a pre-sound-production movement has been detected, the judgment result is "YES" and the CPU 11 proceeds to Step SC5. At Step SC5, the CPU 11 performs note-ON processing for generating a note-ON event and supplying the note-ON event to the sound source section 17.

Next, the CPU 11 proceeds to Step SC6 and judges whether or not an instruction to end the musical performance has been given by the operation of the play switch. When judged that an instruction to end the musical performance has not been given, the judgment result is "NO" and the CPU 11 returns to the processing at Step SC2. Conversely, when judged that an instruction to end the musical performance has been given by the operation of the play switch, the judgment result at Step SC6 is "YES" and the CPU 11 completes the main body processing.

As described above, in the variation example, beat timing based on, for example, the tempo of a song to be played and its beat width is generated and, every time the beat timing comes, whether or not a pre-sound-production movement that is performed prior to sound production has been detected between the preceding beat timing and the current beat timing is judged. Then, when it is judged that a pre-sound-production movement has been detected, an instruction to produce a sound is given. Therefore, an accurate rhythm can be beaten out.

[Second Embodiment]

Next, operations of the electronic percussion instrument 100 according to a second embodiment will be described with reference to FIG. 9 to FIG. 11. In the descriptions below, the operation of the stick processing performed by the CPU 20*a* (second timing generating section, second pre-sound-production movement detecting section, second judging section, and synchronizing section) on the stick section 20 side and the operation of the main body processing performed by the CPU 11 (third timing generating section, sound production instructing section, and synchronizing section) on the main body section 10 side will be described as the operations of the electronic percussion instrument 100.

(1) Operation of Stick Processing

Figure 9:
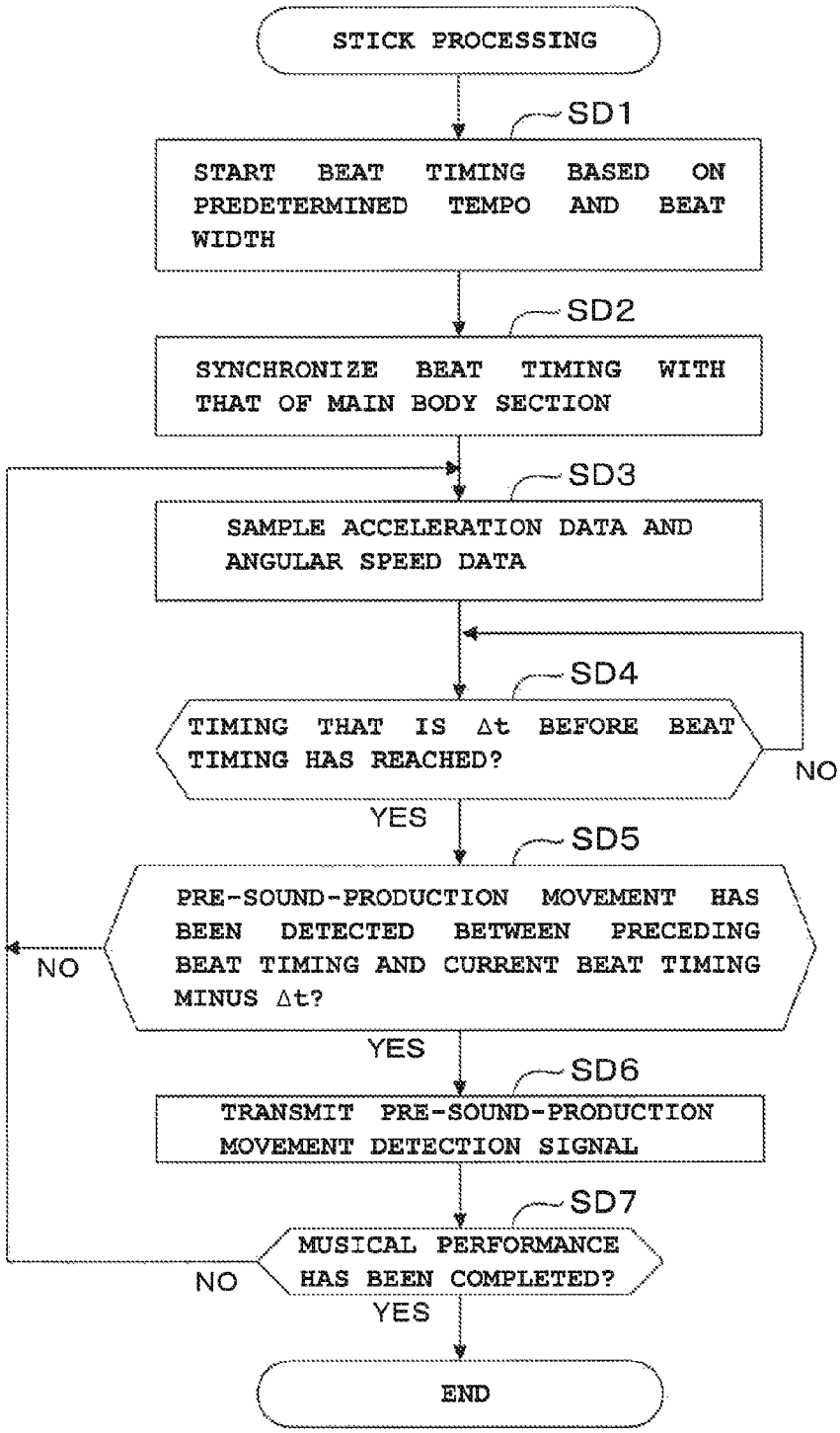
FIG. 9 is a flowchart of the operation of stick processing according to a second embodiment.
Figure 10:
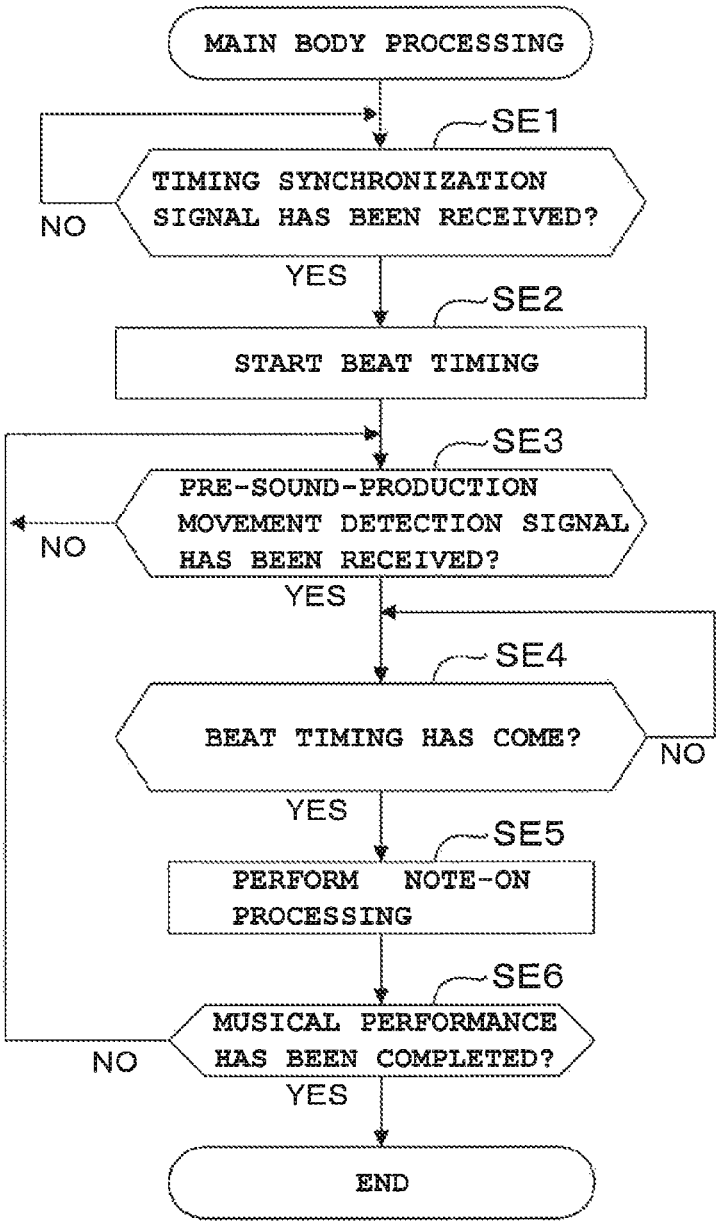
FIG. 10 is a flowchart of the operation of main body processing according to the second embodiment.

As in the case of the above-described first embodiment, when the stick section 20 is turned ON by the operation of the power switch, the CPU 20*a* performs the stick processing shown in FIG. 9 and proceeds to Step SD1. At Step SD1, the CPU 20*a* starts beat timing based on a predetermined tempo and beat width. Next, at Step SD2, the CPU 20*a* wirelessly transmits from the communicating section 20*e* (transmitting section) a timing synchronization signal for synchronizing the beat timing with that on the main body section 10 side. This timing synchronization signal includes time information indicating the beat timing. Next, at Step SD3, the CPU 20*a* stores acceleration data and angular speed data (including identification data) generated by the inertial sensor section 20*d* in a predetermined area of the RAM 20*c*.

Then, at Step SD4, the CPU 20*a* judges whether or not timing that is At before the beat timing has come. When judged that timing that is Δt before the beat timing has not come, the CPU 20*a* waits until timing that is Δt before the beat timing comes. When judged that timing that is Δt before the beat timing has come, the judgment result is "YES" and the CPU 20*a* proceeds to subsequent Step SD5. At Step SD5, the CPU 20*a* judges whether or not a pre-sound-production movement has been detected between the preceding beat timing and the current beat timing minus Δt, based on the acceleration data and angular speed data stored in the predetermined area of the RAM 20*c*.

When judged that a pre-sound-production movement has not been detected, the judgment result is "NO" and the CPU 20*a* returns to the processing at Step SD3. When judged that a pre-sound-production movement has been detected, the judgment result at Step SD5 is "YES" and the CPU 20*a* proceeds to Step SD6. At Step SD6, the CPU 20*a* then generates a pre-sound-production movement detection signal (pre-sound-production stage movement detection signal) and wirelessly transmits it to the main body section 10 side from the communicating section 20*e*. Then, the CPU 20*a* proceeds to Step SD7 and judges whether or not an instruction to end the musical performance has been given by the operation of the play switch. When judged that an instruction to end the musical performance has not been given, the judgment result is "NO" and the CPU 20*a* returns to the processing at Step SD3. When judged that an instruction to end the musical performance has been given by the operation of the play switch, the judgment result at Step SD7 is "YES" and the CPU 20*a* completes the stick processing.

As described above, in the stick processing of the second embodiment, when beat timing based on a predetermined tempo and beat width is started, the beat timing is synchronized with that on the main body section 10 side. Then, every time timing that is Δt before the beat timing comes, whether or not a pre-sound-production movement has been detected between the preceding beat timing and the current beat timing minus Δt is judged based on acceleration data and angular speed data (including identification data) generated by the inertial sensor section 20*d*. When it is judged that a pre-sound-production movement has been detected, a pre-sound-production movement detection signal is generated and wirelessly transmitted to the main body section 10 side from the communication section 20*e*.

(2) Operation of Main Body Processing

Next, the main body processing performed by the CPU 11 on the main body section 10 side will be described with reference to FIG. 10. When the main body section 10 is turned ON by the operation of the power switch, the CPU 11 performs the main body processing shown in FIG. 10 and proceeds to Step SE1. At Step SE1, the CPU 11 judges whether or not a timing synchronization signal wirelessly transmitted from the stick section 20 has been received. When judged that a timing synchronization signal has not been received, the CPU 11 waits until a timing synchronization signal is received. When judged that a timing synchronization signal has been received, the CPU 11 proceeds to Step SE2, and starts beat timing by referencing time information included in the timing synchronization signal. As a result, the beat timing of the stick section 20 side and the beat timing of the main body section 10 side are synchronized.

When the beat timing of the stick section 20 side and the beat timing of the main body section 10 side are synchronized, the CPU 11 proceeds to Step SE3. At Step SE3, the CPU 11 judges whether or not the communicating section 16 (receiving section) has received a pre-sound-production movement detection signal wirelessly transmitted from the stick section 20. When judged that the communicating section 16 has not received a pre-sound-production movement detection signal, the CPU 11 waits until the communicating section 16 receives a pre-sound-production movement detection signal. When judged that the communicating section 16 has received a pre-sound-production movement detection signal, the judgment result is "YES" and the CPU 11 proceeds to Step SE4. At Step SE4, the CPU 11 judges whether or not the beat timing has come. When judged that the beat timing has not come, the CPU 11 waits until the beat timing comes. When judged that the beat timing has come, the judgment result is "YES" and the CPU 11 proceeds to Step SE5.

At Step SE5, the CPU 11 performs note-ON processing for generating a note-ON event and supplying the note-ON event to the sound source section 17. Then, the CPU 11 proceeds to Step SE6 and judges whether or not an instruction to end the musical performance has been given by the operation of the play switch. When judged that an instruction to end the musical performance has not been given, the judgment result is "NO" and the CPU 20*a* returns to the processing at Step SE3. When judged that an instruction to end the musical performance has been given by the operation of the play switch, the judgment result at Step SE6 is "YES" and the CPU 11 completes the main body processing.

In the main body processing of the second embodiment, when a timing synchronizing signal wirelessly transmitted from the stick section 20 is received, beat timing is started by referencing time information included in the received timing synchronization signal, as described above. Then, when the beat timing of the stick section 20 side and the beat timing of the main body section 10 side are synchronized thereby, an instruction to produce a sound production is given at beat timing that comes after a pre-sound-production operation detection signal wirelessly transmitted from the stick section 20 is received.

Figure 11:
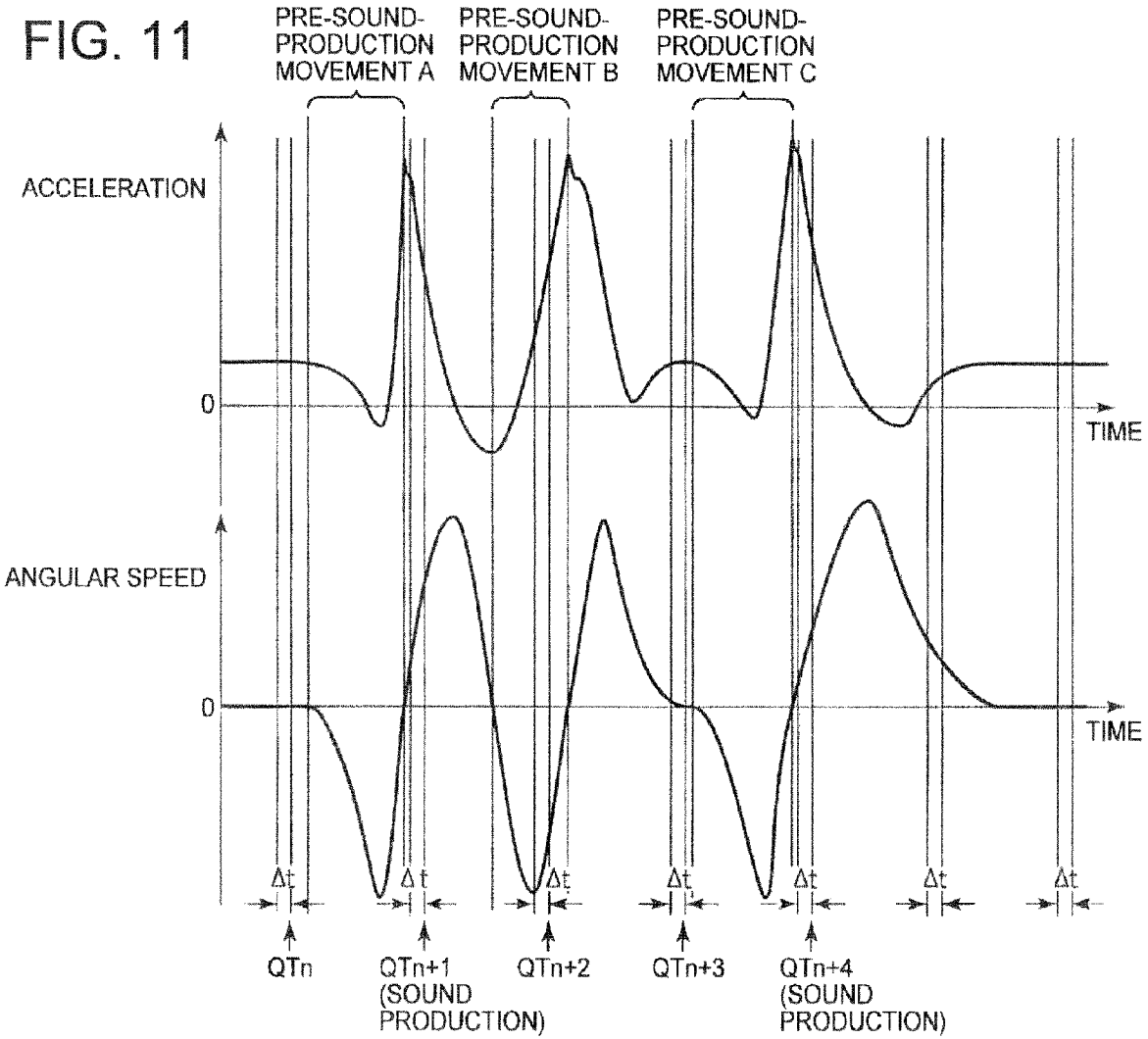
FIG. 11 is a diagram for explaining the movements of the second embodiment.

Therefore, in a case where the stick section 20 is being swung upward and downward as shown in the example of output characteristics in FIG. 11, because a pre-sound-production movement is not detected at Δt before beat timing QTn, a note-ON event is not generated. In addition, because a pre-sound-production movement A is detected at Δt before the next beat timing QTn+1, a note-ON event is generated at the beat timing QTn+1. Moreover, because a pre-sound-production movement B is not detected at Δt before beat timing QTn+2, a note-ON event is not generated at the beat timing QTn+2. Furthermore, because a pre-sound-production movement is not detected at Δt before beat timing QTn+3, a note-ON event is not generated at the beat timing QTn+3. Still further, because a pre-sound-production movement C is detected at Δt before the next beat timing QTn+4, a note-ON event is generated at the beat timing QTn+4.

As described above, whether or not a pre-sound-production movement has been made is judged at Δt before beat timing and, when it is judged that a pre-sound-production movement has been made, an instruction to produce a sound is given at the beat timing. Therefore, for example, even when a transmission delay τ occurs on the communication path between the stick section 20 and the main body section 10, the transmission delay τ is cancelled by Δt if the transmission delay τ is less than Δt. Accordingly, an instruction to produce a sound is given at the beat timing and an accurate rhythm can be beaten out.

In the configurations of the above-described embodiments, beat timing is generated based on a predetermined tempo and beat width. However, the present invention is not limited thereto, and a configuration may be adopted in which a beat is extracted from a stick operation (drum performance) performed by a user, and beat timing in accordance with a tempo based on the extracted beat and a beat width designated by the user are generated. Additionally, in above-described embodiments, only an instruction to generate a percussion instrument sound (note-ON) is given. However, musical sound control may be performed instead, in which a constant gate time is set or, when a new instruction for note-ON is given, the note-OFF of a musical sound that is currently being produced is instructed.

Moreover, in above-described embodiments, beat timing comes at even intervals. However, a groove beat timing can be used instead in which a beat width is changed to achieve so-called groove, such as playing before or after a beat, shuffle, and swing. In addition, humanization can be used by which random rhythm variation is intentionally added.

While the present invention has been described with reference to the preferred embodiments, it is intended that the invention be not limited by any of the details of the description therein but includes all the embodiments which fall within the scope of the appended claims.

What is claimed is:

1. An electronic percussion instrument comprising:

a stick; and a main body section;

wherein the stick includes:

a detecting section which detects an acceleration and an angular speed based on movement of the stick;

a first timing generating section which generates a beat timing based on a predetermined tempo and beat width;

a first pre-sound-production movement detecting section which detects a pre-sound-production movement that is performed prior to sound production, based on the acceleration and the angular speed detected by the detecting section;

a first judging section which judges whether or not the first pre-sound-production movement detecting section has detected the pre-sound-production movement between a predetermined amount of time before a preceding beat timing and a predetermined amount of time before a current beat timing; and a transmitting section which transmits a pre-sound-production movement detection signal, when the first judging section judges that the pre-sound-production movement has been detected; and wherein the main body section includes:

a receiving section which receives the pre-sound-production movement detection signal transmitted from the stick;

a second timing generating section which generates a beat timing based on a predetermined tempo and beat width; and a sound production instructing section which instructs to produce a sound at the beat timing generated by the second timing generating section, when the receiving section receives the pre-sound-production movement detection signal.

2. The electronic percussion instrument according to claim 1, wherein the stick and the main body section include a synchronizing section which synchronizes the beat timing generated by the first timing generating section provided in the stick with the beat timing generated by the second timing generating section provided in the main body section.

3. A non-transitory computer-readable storage medium having stored thereon a program that is executable by a computer in a stick and a computer in a main body section, wherein the program is executable by the computer in the stick to perform functions comprising:

detection processing for detecting an acceleration and an angular speed based on movement of the stick;

first timing generation processing for generating a beat timing based on a predetermined tempo and beat width;

first pre-sound-production movement detection processing for detecting a pre-sound-production movement that is performed prior to sound production, based on the acceleration and the angular speed detected in the detection processing;

first judgment processing for judging whether or not the pre-sound-production movement has been detected in the first pre-sound-production movement detection processing between a predetermined amount of time before a preceding beat timing and a predetermined amount of time before a current beat timing; and transmission processing for transmitting a pre-sound-production movement detection signal, when the pre-sound-production movement is judged to have been detected in the first judgment processing; and wherein the program is executable by the computer in the main body section to perform functions comprising:

reception processing for receiving the pre-sound-production movement detection signal transmitted in the transmission processing;

second timing generation processing for generating a beat timing based on a predetermined tempo and beat width; and sound production instruction processing for instructing to produce a sound at the beat timing generated in the second timing generation processing, when the pre-sound-production movement detection signal is received in the reception processing.

* * * * *